US006348769B1

(12) United States Patent
Pinchuk et al.

(10) Patent No.: US 6,348,769 B1
(45) Date of Patent: Feb. 19, 2002

(54) ELECTRONIC BALLAST

(75) Inventors: Dmitry Pinchuk, deceased, late of Bnei-Brak; by Lodmila Pinchuk, legal representative; by Neli Pinchuk, legal representative, both of Netanya; David Yoskovich, Rishon LeZion, all of (IL)

(73) Assignee: Clalight Israel Ltd., Netanya (IL)

( * ) Notice: Subject to any disclaimer, the term of this patent is extended or adjusted under 35 U.S.C. 154(b) by 0 days.

(21) Appl. No.: 09/472,195

(22) Filed: Dec. 27, 1999

Related U.S. Application Data

(63) Continuation-in-part of application No. PCT/IL99/00687, filed on Dec. 15, 1999, and a continuation-in-part of application No. 09/215,952, filed on Dec. 18, 1998, now Pat. No. 6,111,369.

(51) Int. Cl.[7] ..... G05F 1/00

(52) U.S. Cl. ..... 315/307; 315/244; 315/291; 315/94; 315/324; 315/DIG. 5

(58) Field of Search ..... 315/94, 106, 244, 315/209 R, 224, 276, 291, 307, 290, 324, DIG. 5, DIG. 7

(56) References Cited

U.S. PATENT DOCUMENTS 5,363,020 A * 11/1994 Chen et al. ..... 315/209 R
5,426,350 A * 6/1995 Lai ..... 315/244
5,729,096 A * 3/1998 Liu et al. ..... 315/225
6,057,652 A * 5/2000 Chen et al. ..... 315/307
6,111,369 A * 8/2000 Pinchuk et al. ..... 315/307

* cited by examiner

*Primary Examiner*—Haissa Philogene
(74) *Attorney, Agent, or Firm*—Edward Langer, Pat. Atty.

(57) ABSTRACT

An electronic ballast for providing electrical energy to one or more fluorescent lamps having electrical discharge filaments. The ballast includes a pre-heating circuit having a first resonant frequency, coupled to pre-heat the filaments. An ignition driver circuit having a second resonant frequency is coupled to ignite an electrical discharge through a gas between the filaments. Power controller circuitry provides power to the pre-heating and ignition driver circuits in succession, so as to ignite the one or more lamps. The power controller circuitry first provides power to the pre-heating circuit substantially at the first resonant frequency and subsequently provides power to the ignition driver circuit substantially at the second resonant frequency, by a smooth operating frequency transition from pre-heating to ignition. The ballast also features a voltage-controlled pre-heating circuit, and circuit configuration capable of igniting the lamps even in the case where one or both of the filaments are broken.

36 Claims, 5 Drawing Sheets

ELECTRONIC BALLAST

This application is a continuation-in-part PCT/IL99/00687 filed Dec. 15, 1999 and a CIP of application Ser. No. 09/215,952 filed Dec. 18, 1998, subsequently issued as U.S. Pat. No. 6,111,369, on Aug. 29, 2000.

FIELD OF THE INVENTION

The present invention relates generally to circuitry for electronic ballasts for use with fluorescent lamps, and more particularly to an electronic ballast designed to extend the the life of lamps by operation of a power controller applying two complementary high frequencies, a first frequency for filament pre-heating under fixed voltage control and a second complementary frequency, applied after a frequency adjustment-based transition period, for lamp ignition.

BACKGROUND OF THE INVENTION

It is known in the prior art to use a ballast circuit to heat the two filaments of a fluorescent lamp to a high temperature, such that when an electric field is applied between the filaments, they more easily emit electrons and ionize the gas in the lamp. Responsive to radiation generated due to the electric current flowing through the gas, phosphors coating the inner surface of the lamp fluoresce, emitting visible light. The ballast typically controls both the initial ignition and the steady-state operation of the lamp.

Electronic ballasts apply this pre-heating circuitry prior to lamp ignition to lengthen lamp filament life, and thus lamp life, by increasing the concentration of electrons with a sufficient energy level to be discharged from the metal filament when a starting or striking voltage is applied to it. Typically, prior art pre-heating circuits operate using a current control technique, to maintain the filament heating current at a constant value. The resulting filament power dissipation which results is according to the standard equation, $P=I^2R$ where P is the power dissipated in the filament, I is the constant current, and R is the filament resistance.

When the lamp is new, the cold resistance of the filament is significantly lower than its value after the lamp has been in use over a period of time. Thus, according to the filament power dissipation equation above, the ageing of the filament causes it to have an increasing power dissipation. The lamp dims over time as this increasing power dissipation causes the filament to deteriorate more rapidly, until finally the filament breaks and the lamp ceases to ignite.

Examples of electronic ballasts incorporating current-controlled pre-heating circuitry include U.S. Pat. No. 5,656,891 to Luger et al., which discloses a continuously variable heating power, and U.S. Pat. No. 5,500,576 to Russell, which discloses a predetermined lamp warm-up time using current control. PCT Pat. Appln. publication WO 97/13391 discloses the use of low-voltage windings of a transformer to supply sufficient current to pre-heat the filaments.

It is also known in the prior art of electronic ballast design to provide a lamp driving circuit which operates at one frequency during the pre-heating phase of lamp, and at a different steady-state operating frequency. In U.S. Pat. No. 4,553,071 to Boyd, a ballast is disclosed having a tuned circuit which limits the current during warm-up, and when the lamp filament resistance increases, the tuned circuit develops a starting voltage for lamp ignition.

U.S. Pat. No. 5,686,798 to Mattas provides a single driving signal frequency, as contrasted with ballasts which operate at more than one frequency and use feedback circuitry to sense when lamp ignition has occurred so as to determine when to switch between the frequencies.

U.S. Pat. No. 4,641,061 to Munson discloses a ballast operating at a selected frequency high enough to develop a starting voltage, while being below the resonant frequency of the LC circuit coupled to the lamp. After starting conduction through the lamps, the frequency is reduced to a frequency substantially below the selected frequency, to limit the current flow.

U.S. Pat. No. 5,021,714 to Swanson et al discloses a circuit for starting and operating fluorescent lamps from an AC low-frequency power source. A ballast generates a voltage, whose frequencies include a plurality of harmonics of the power-source frequency, which voltage causes a capacitor and a cathode heating transformer to resonate responsive to the harmonics. The resonant voltage is applied across the fluorescent lamps to aid the starting of their discharge, and thereafter the lamps operate at the AC power source frequency.

U.S. Pat. No. 5,723,953 to Nerone et al., discloses a high voltage gas discharge lamp ballast, including a resonant load circuit which incorporates the lamp, and includes two resonant impedances whose values determine the operating frequency of the resonant load circuit. High voltage switches are used to disconnect the lamp's filaments during the pre-heating phase.

U.S. Pat. Nos. 5,208,511 and 5,175,470 to Garbowicz, disclose a fluorescent lamp system which includes a ballast with primary and secondary windings and a switch for each electrode of each of the lamps in the lamp system. Each switch operates in response to the voltage across its associated lamp, such that after the lamp turns on, the switch interrupts the connection of its associated electrode to a heater winding.

Additionally, U.S. Pat. No. 5,015,923 to Nilssen, U.S. Pat. No. 5,563,473 to Mattas et al., and U.S. Pat. No. 5,677,602 to Paul et al., describe other electronic ballasts for use with fluorescent lamps.

As described above, lamp operation is here comprised of a filament pre-heating phase and a lamp ignition phase. In the lamp ignition phase, which follows the filament pre-heating phase, a relatively high voltage is placed across the lamp. Prior art electronic ballasts which rely on a switching arrangement to handle the transition between these phases, such as the pre-conditioner of the above-mentioned Mattas patent, do not account for the actual filament conditions obtaining after the pre-heating phase. That is, if there has been sufficient filament pre-heating, a relatively low starting voltage across the lamp is all that is needed to ignite the lamp and the filament is thereby not overly stressed. Whereas, if the filament pre-heating has been less than sufficient, then a typically higher starting voltage will be required to ignite the lamp, and this higher starting voltage of existing ballast designs will develop a stress on the filaments during ignition, thereby shortening the life of the filament, and thus the life of the lamp.

Once a lamp filament has been broken, the useful life of the lamp is effectively over. The application of starting voltage to such a lamp may be hazardous, as dangerously high voltages may be produced at the lamp socket terminals. In U.S. Pat. No. 5,747,941 to Shackle et al., an electronic ballast is disclosed which prevents a starting cycle if the lamp filaments are not intact.

As can be seen from the above, in order for electronic ballast design to extend lamp life, it must (1) overcome the problems related to constant current control as a means of filament pre-heating, since the resulting filament power dissipation will increase as the lamp ages, and (2) it must provide a transition to lamp ignition in such a way that prevents premature application of the lamp ignition voltage, before completion of the pre-heating phase.

Therefore, it would be desirable to overcome the above-mentioned problems related to pre-heating and ignition associated with existing electronic ballast designs, and provide an efficient, compact and inexpensive electronic ballast design capable of extending lamp life.

SUMMARY OF THE INVENTION

It is an object of the present invention to provide an improved ballast circuit for use in operating a fluorescent lamp in order to extend lamp life.

It is another object of some aspects of the present invention to provide improved devices and methods for pre-heating, igniting, and maintaining efficient steady-state operation of a fluorescent lamp.

It is a further object of some aspects of the present invention to provide improved devices and methods for generating a smooth transition between the pre-heating phase, the ignition phase, and the steady-state phase of fluorescent lamp operation.

In accordance with a preferred embodiment of the present invention, there is provided an electronic ballast for providing electrical energy to one or more fluorescent lamps having electrical discharge filaments, said ballast comprising:

- a pre-heating circuit having a first resonant frequency, coupled to pre-heat the filaments;
- an ignition driver circuit having a second resonant frequency, coupled to ignite an electrical discharge through a gas between the filaments; and
- power controller circuitry, which provides power to the pre-heating and ignition driver circuits in succession so as to ignite the one or more lamps by first providing power in a constant voltage configuration to the pre-heating circuit substantially at the first resonant frequency in a pre-heating phase and subsequently providing power to the ignition driver circuit substantially at the second resonant frequency in an ignition phase.

In preferred embodiments of the present invention, an electronic ballast is provided for at least one fluorescent lamp, comprising two tuned resonant circuits, a pre-heating circuit and an ignition driver circuit. The two resonant circuits resonate at substantially different respective resonant frequencies, F1 and F2, responsive to a voltage signal generated by a signal generator portion of a power controller circuit. The voltage signal preferably has, at any given time, substantially only one frequency component, so that the first and second resonant circuits do not resonate simultaneously. This design insures that pre-heating is completed before the ignition signal can be applied.

Resonance of the first resonant circuit preferably causes a relatively high "pre-heating" voltage to be generated in parallel across filaments of the lamp. This voltage drives current through the filaments in order to cause resistive heating of the filaments. Preferably, during this period of resonance, the voltage across the lamp (as distinguished from the voltage across each of the filaments) is maintained at a relatively low level, in order to prevent pre-ignition of the lamp. The signal generator typically continues to output the signal at F1 (the frequency corresponding to the resonant frequency of the first resonant circuit) while the filaments are increasing in temperature.

The voltage across the filaments is controlled so as be relatively constant. In accordance with the principles of the invention, the use of voltage control instead of current control as in the prior art, greatly increases lamp life. Since it is known that as the filaments age their resistance goes up, then according to the equivalent filament power dissipation equation for voltage, $P=V^2/R$, since V is now constant, the power dissipated in the filament decreases over time, which is turn greatly increases the life of the filament, and hence of the lamp, compared to constant current control techniques.

When the filaments have reached a temperature suitable for ignition of gas within the lamp, output of the signal generator preferably smoothly changes from F1 to F2, in order to: (a) substantially terminate resonance in the first circuit and thereby reduce the voltage which causes heating of the filaments; and (b) initiate resonance in the second circuit, causing a large voltage drop across the lamp, thereby causing electron-discharge which develops a current flowing between the filaments in order to ignite the gas within the lamp. The time interval for preheating is preset so as to insure sufficient filament preheating has taken place before the ignition signal is applied.

Thereafter, the signal generator preferably continues the smooth change in its output frequency to a third frequency, F3, which is relatively close to F2, but relatively far from F1, in order to begin a steady-state operational phase of the ballast, characterized by: (a) provision of current necessary to operate the lamp; and (b) improved efficiency relative to ballasts known in the art, due to relatively low power losses from the filaments during steady-state operation. Additional lamp life is also achieved by minimizing filament power dissipation during steady-state operation of the lamp.

The ballast of the present invention thus differs from ballasts known in the art (e.g., U.S. Pat. No. 5,208,511, described hereinabove) which use switches to control pre-heating and ignition and do not use two respective resonant circuits to perform these functions. By using at least two resonant circuits with respective resonant frequencies, which are driven to resonate at different times responsive to a control signal for pre-heating, ignition, and steady-state operation of one or more fluorescent lamps, ballasts in accordance with the present invention can be made generally less costly and more reliable than ballasts known in the art.

In some preferred embodiments of the present invention, the ballast supplies voltage to pre-heat, ignite, and support the steady-state operation of two or more fluorescent lamps. Preferably, the two or more lamps are connected in series, and the filaments therein are connected in parallel. Further preferably, the filaments are pre-heated in parallel, and current flows in series through the lamps during the ignition and steady-state phases.

Preferably, the voltage drop across the lamps (as distinguished from the drop across the filaments therein) is maintained at a low level during the pre-heating phase, in order to prevent pre-ignition, i.e., ignition of the lamps prior to the attainment of an appropriate filament temperature. As discussed above, pre-ignition damages filaments, thereby reducing the life-span of fluorescent lamps.

Further preferably, the flow of electrons through the filaments (but not through the ionized gas), which is maintained at a high level during the pre-heating phase, is substantially reduced during steady-state operation, resulting in reduced electric power consumption and longer filament life and hence lamp life.

Preferably, the pre-heating circuit is coupled to the filaments in parallel. Further preferably, the ballast provides energy to two or more fluorescent lamps, such that the ignition driver circuit is coupled in series across the filaments of the two or more lamps.

In the preferred embodiment, the ballast design as described further herein, with lamps in series across the ignition driver circuit and filaments in parallel across the pre-heating circuit, is unique in that even with a broken filament, sufficient ignition voltage will be placed across the lamps to ignite them. This is true in the case of a single broken filament, where there is partial pre-heating by the second filament, enabling the electron-discharge. It is also true in many cases with both filaments broken. This feature further extends lamp life.

In a preferred embodiment, the power controller circuitry acts as a driver which smoothly varies the frequency at which it provides power from the first resonant frequency to the second resonant frequency in order to terminate pre-heating and initiate ignition.

Preferably, the power controller circuitry, subsequent to ignition, varies the output frequency to a third frequency, in order to drive current through the gas and cause the one or more lamps to emit light. Further preferably, the magnitude of the current driven at the third frequency is lower than the magnitude of the current driven at the second frequency.

Preferably, when the power controller circuitry provides the power at the first resonant frequency, the voltage drop generated by the ignition driver circuit between the filaments is less than an ignition threshold of the one or more lamps.

In a preferred embodiment, after ignition of the one or more lamps, energy generated by the pre-heating circuit that is dissipated by the filaments is substantially less than energy generated by the ignition driver circuit that is dissipated in the gas between the filaments.

There is further provided, in accordance with a preferred embodiment of the present invention, a method for providing electrical energy to one or more fluorescent lamps having filaments, including:

generating a driving current at a first frequency to pre-heat the filaments of the one or more lamps; and changing the driving current to a second frequency in order to ignite an electrical discharge between the filaments within the one or more lamps.

Preferably, generating the driving current at the first frequency includes generating a resonant current flow in pre-heating circuitry coupled to the one or more fluorescent lamps in order to drive current through the filaments.

Further preferably, generating the driving current at the second frequency includes generating the flow of a resonant current in ignition driver circuitry coupled to the one or more fluorescent lamps in order to drive current through gas between the filaments in the one or more lamps.

In a preferred embodiment, changing the driving current includes smoothly modulating the frequency of the driving current from the first frequency to the second frequency.

The smooth transition of the frequency from the first to the second frequency causes ignition of the lamps, when the appropriate voltage is developed across the second resonant circuit comprising the ignition driver circuit. Since the pre-heating circuit has sufficiently heated the filaments, this voltage does not apply an excessive stress to the filaments, thereby extending the lamp life.

Preferably, the driving current is changed from the second frequency to a third frequency in order to drive current through the gas and cause the one or more lamps to emit light. Further preferably, the magnitude of the current driven at the third frequency is lower than the magnitude of the current driven at the second frequency.

Still further preferably, driving the current at the first resonant frequency includes providing energy to the one or more lamps such that the voltage drop generated by the ignition driver circuit between the filaments is less than an ignition threshold of the one or more lamps.

In a preferred embodiment, changing the current to the second frequency includes providing energy to the one or more lamps such that after ignition thereof, energy generated by the preheating circuit that is dissipated across the filaments is substantially less than energy generated by the ignition driver circuit that is dissipated in the gas between the filaments.

As mentioned above, advantages of the inventive electronic ballast in extending the lamp life are due to the voltage-controlled pre-heating circuit, and the smooth operating frequency transition from pre-heating to ignition. In addition, the inventive electronic ballast is capable of igniting the lamps even in the case of broken filaments. Other features and advantages of the invention will become apparent from the following drawings and description.

BRIEF DESCRIPTION OF THE DRAWINGS

For a better understanding of the invention with regard to the embodiments thereof, reference is made to the accompanying drawings, in which like numerals designate corresponding elements or sections throughout, and in which.

Table I shows test results of electronic ballasts of different manufacturers, including the present invention; and Table II shows a list of components and typical values for assembling a preferred embodiment of the invention.

DETAILED DESCRIPTION OF THE PREFERRED EMBODIMENTS

Figure 1:
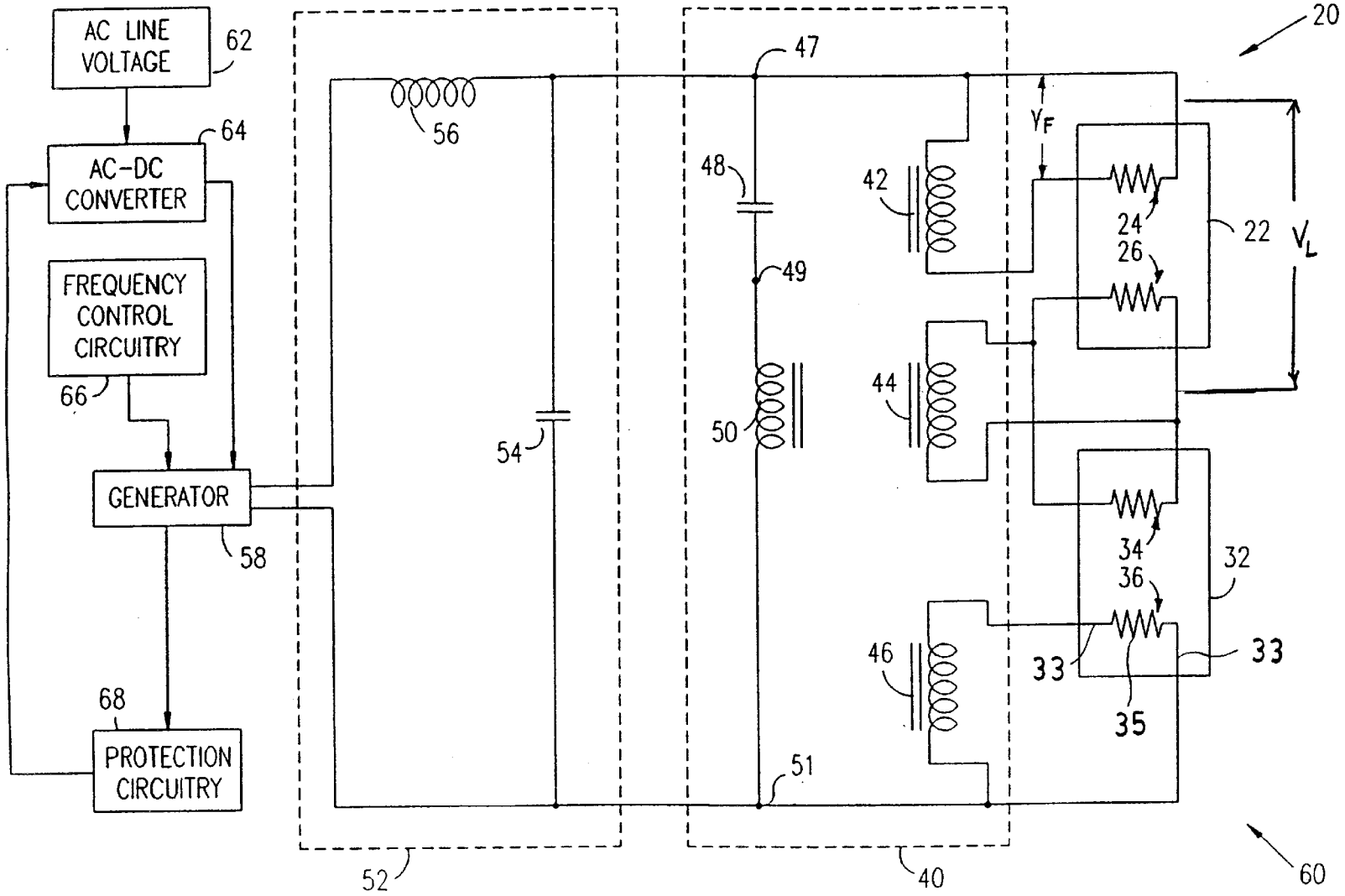
FIG. 1 is a simplified electrical schematic illustration of a fluorescent lamp including an electronic ballast circuit, in accordance with a preferred embodiment of the present invention.

FIG. 1 is a schematic illustration of a fluorescent lamp 20, comprising two fluorescent light lamps 22 and 32 and an electronic ballast circuit 60 coupled to the lamps to provide power thereto, in accordance with a preferred embodiment of the present invention. Ballast 60 preferably comprises: (a) power controller circuitry, comprising a signal generator 58 coupled to an AC-DC converter 64, frequency control circuitry 66, and protection circuitry 68; (b) a resonant pre-heating circuit 40 coupled to generator 58; and (c) a resonant ignition driver circuit 52 coupled to generator 58.

In accordance with the principles of the present invention, the ballast configuration utilizes a parallel connection of the filaments 24, 26 and 34, 36 of respective lamps 22 and 32 across the secondary windings of transformer 50, and a series connection of the lamps 22, 32 across the output of the electronic ballast 60 itself.

The operation of electronic ballast circuit 60, as further described herein, proceeds in three phases, corresponding to pre-heating, ignition and steady-state phases,based on the driving frequency output of generator 58.

In operation, as will be described in greater detail hereinbelow, lamps 22 and 32 are coupled to pre-heating circuit 40 in parallel so that, during the pre-heating phase, circuit 40 resonates and current is driven through filaments 24 and 26 in lamp 22 and through filaments 34 and 36 in lamp 32, in order to cause resistive heating of the filaments to a temperature appropriate for ignition of gas within the respective lamps. Conversely, during the ignition phase, ignition driver circuit 52 operates in resonant and near-resonant modes, and lamps 22 and 32 are ignited and sustained in a discharging mode by current driven from the resonating ignition driver circuit 52 through the filaments and ionized gases in the series-connected lamps 22 and 32. By setting the values of components within resonant circuits 40 and 52 appropriately, substantially only one of the circuits resonates at any given time responsive to the output of signal generator 58. The use of two resonant circuits with separate resonating modes provides significant advantages to this embodiment of the present invention compared to ballasts known in the prior art, as explained hereinbelow.

Resonant pre-heating circuit 40, having a resonant frequency F1, preferably comprises a capacitor 48 in series with a transformer primary 50. When the frequency of the signal from generator 58 is near F1, the voltage drop across transformer primary 50 is relatively high (typically about 1000 volts RMS), and this voltage is reflected through the transformer via the magnetic field generated thereby, causing current to flow through transformer secondaries 42, 44, and 46 inductively coupled thereto. Current flow induced in transformer secondaries 42, 44, and 46 sends current through filament 24, filaments 26 and 34, and filament 36, respectively, in order to generate the desired pre-heating thereof.

Filaments 24, 26, 34 and 36 each have a structure comprising a pair of low resistance electrical in-leads 33 for connection external to the lamp envelope, with a resistive-heating portion 35 connected between them.

Figure 3A:
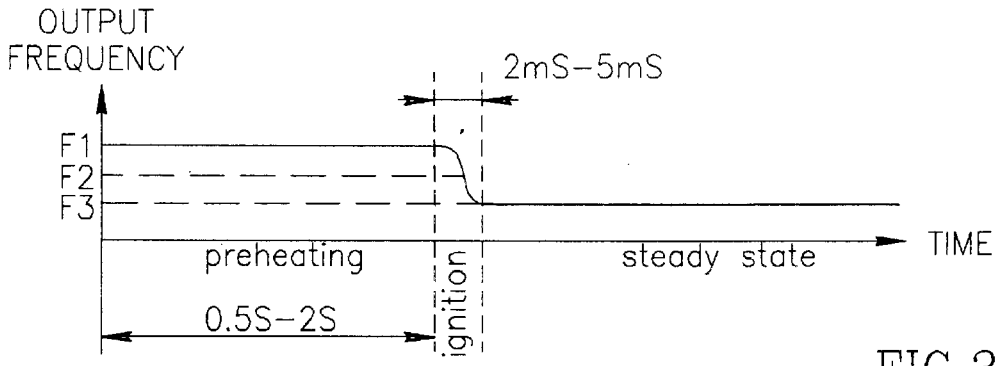
FIGS. 3*a–d* show waveforms displaying the operation of the electronic ballast circuit of FIG. 1 as a function of time, respectively in terms of output frequency, lamp voltage, filament voltage and filament power dissipation.
Figure 3B:
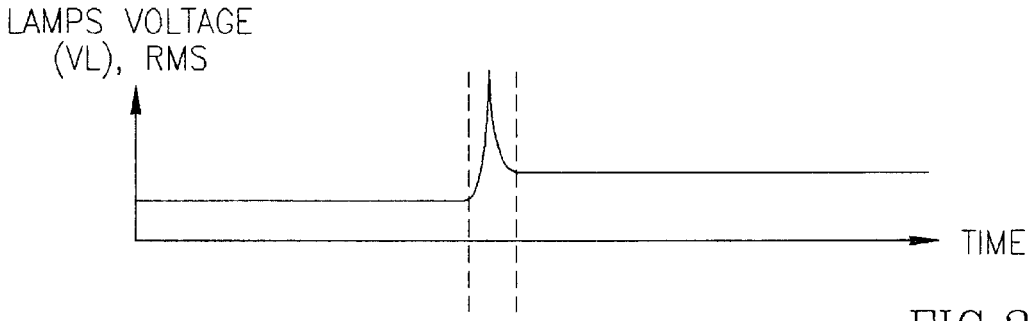
Figure 3C:
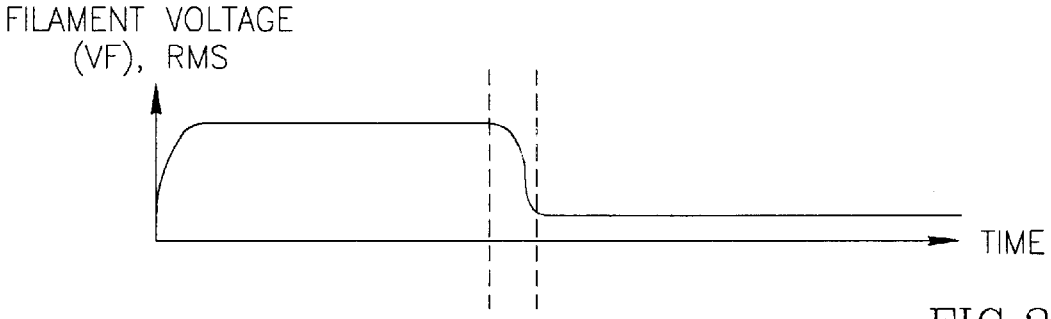

As described further herein with reference to FIG. 3*c*, the voltage developed across the filaments VF is maintained relatively constant, based on a voltage-control technique.

F1 preferably ranges from about 40 kHz to about 60 kHz. The desired frequency is typically attained by setting capacitor 48 to have a capacitance between about 1 and about 8 nF and by choosing for transformer primary 50 a winding with an inductance between about 2 and about 8 mH. The ratio of the inductance of transformer primary 50 to the inductance of each of the transformer secondaries is preferably between about 50:1 and about 100:1, and is typically approximately 70:1. It will be understood by one skilled in the art that utilizing pre-heating circuit 40 as shown in FIG. 1 is just one of many possible ways to make a resonant circuit which pre-heats filaments in a fluorescent lamp.

When pre-heating circuit 40 is near resonance, the respective voltage drops across transformer primary 50 and across capacitor 48 are high but in opposite directions, i.e., the voltage drop across capacitor 48 measured from a point 49 on one side thereof to a point 47 on another side thereof is generally similar to the voltage drop across transformer primary 50 measured from point 49 to a point 51 on the other side of transformer primary 50. Thus, even though there is relatively high current flow through transformer primary 50 during resonance of circuit 40, there is nevertheless only a very small voltage drop between point 47 and point 51.

Therefore, during the resonance associated with the pre-heating phase, there is also only a small voltage drop across lamps 22 and 32 coupled in series between points 47 and 51. The resultant small voltage drop is desirable because it avoids the inefficient, and possibly damaging, pre-ignition of lamps 22 and 32. At the same time, the voltage across the individual filaments themselves is high.

Ignition driver circuit 52, characterized by a resonant frequency F2, preferably comprises an inductor 56 coupled to generator 58 and to a capacitor 54, which capacitor is additionally coupled between points 47 and 51. During the pre-heating phase, when the output of generator 58 is at frequency F1, circuit 52 generally does not resonate. The voltage drop across capacitor 54 during the pre-heating phase is relatively low, on account of the resonance of circuit 40, as described hereinabove.

After a predetermined interval has elapsed, the pre-heating phase is completed, and the frequency output from generator 58 is changed, preferably smoothly, from F1 to F2, causing pre-heating circuit 40 to stop resonating and causing ignition driver circuit 52 to begin to resonate. Responsive to the initiation of resonance in circuit 52, the voltage drop across capacitor 54—which is substantially equal to the voltage drop across lamps 22 and 32—increases to a magnitude, typically referred to as the striking voltage, which is sufficient to initiate ignition of the pre-heated filaments. Additionally, termination of resonance in circuit 40 causes a significant decrease of the voltage drop across secondaries 42, 44, and 46, and a corresponding decrease in the current flow from the secondaries into the filaments of lamps 22 and 32.

The smooth transition of frequency between the first and second resonant frequencies F1 and F2 occurs, preferably, in a gradient of approximately 30 KHz/5 msec, although a suitable adjustment to this value is achievable using skill of the art design techniques, to obtain a smooth transition. The time interval of the gradient may vary within a +/−20% range.

In order to begin a steady-state phase, output from generator 58 subsequent to ignition optionally transitions smoothly to a third frequency, F3, usually closer to F2 than to F1. By way of illustration and not limitation, typical values for F1, F2, and F3 are, respectively, 40–60 kHz, 25–35 kHz, and 22–32 kHz. Circuit 52 is preferably near resonance at F3, and generates a relatively stable current through lamps 22 and 32 during the steady-state phase.

For most applications of the present invention, generator 58 is coupled to and powered by AC-DC converter 64, which outputs a DC voltage that is preferably greater than the peak absolute magnitude of an AC line voltage source 62 supplying electricity for ballast 60. By way of illustration and not limitation, when the line voltage is approximately 230 VAC, AC-DC converter 62 typically outputs approximately 400 VDC. Additionally, AC-DC converter 62 preferably performs power-factor correction of the AC input voltage, as is known in the prior art, in order to produce the desired DC output voltage.

Frequency control circuitry 66, coupled to generator 58, preferably generates a voltage signal whose magnitude determines the output frequency of signal generator 58, in order to cause resonant pre-heating circuit 40 and resonant ignition driver circuit 52 to perform their respective functions at the proper times. Generator 58 typically comprises a standard half-bridge driver, as is known in the art, a current sensor, and circuitry to modify the output frequency of generator 58 responsive to the signal coming from frequency control circuitry 66. It is understood that there are many ways of generating a signal of varying frequency to cause resonance in two resonant circuits, and the embodiment shown in FIG. 1 is an example of one of these.

Protection circuitry 68, coupled to generator 58 and AC-DC converter 64, preferably monitors current flow from generator 58 and causes AC-DC converter 64 to substantially terminate output (thereby turning off fluorescent lamp 20) in the event of excess current draw from generator 58.

Figure 2:
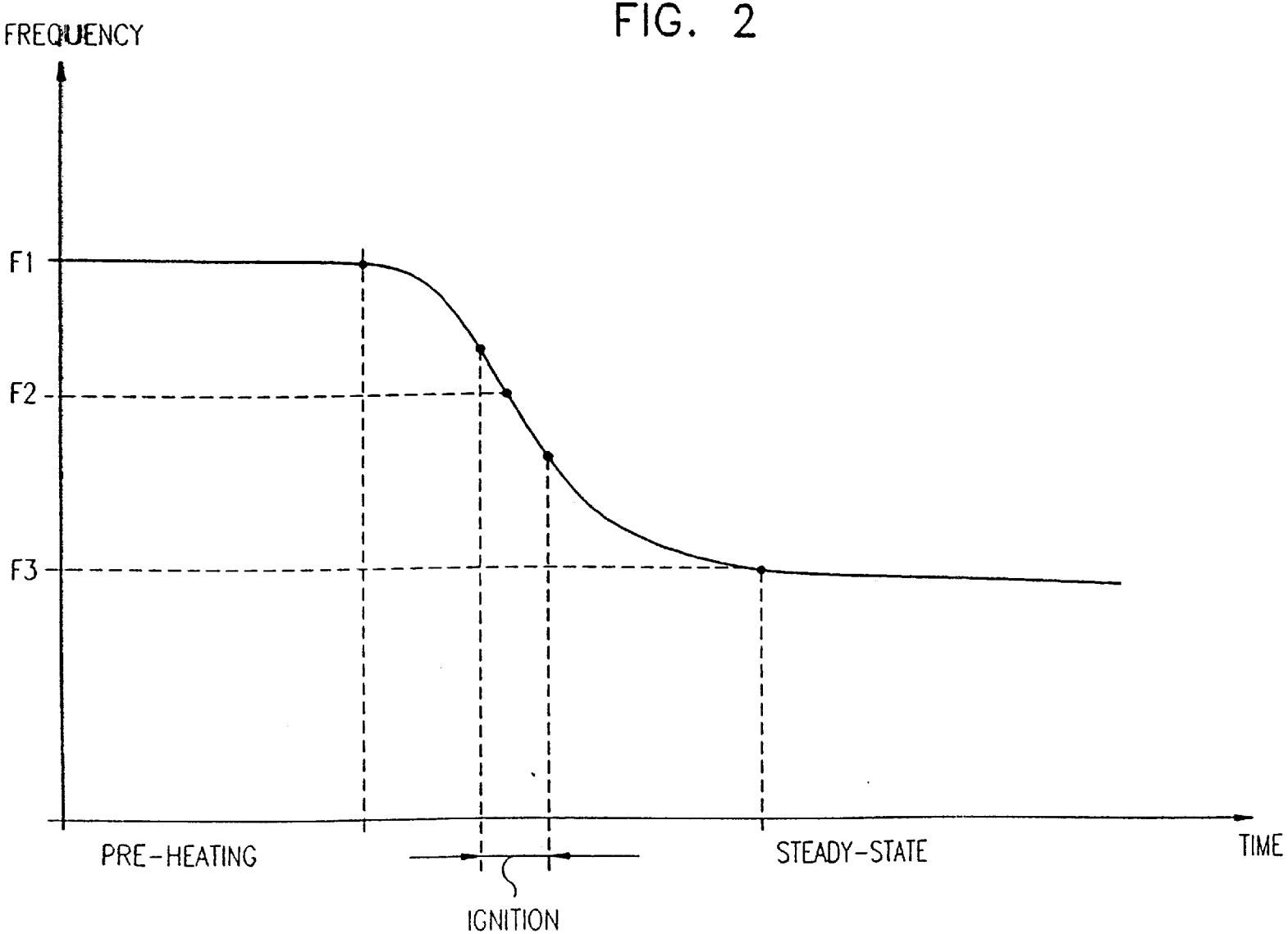
FIG. 2 is a graph showing a signal frequency as a function of time, generated within the lamp of FIG. 1, in accordance with a preferred embodiment of the present invention.

FIG. 2 is a graph showing schematically the frequency of the signal generated by generator 58 as a function of time, in accordance with a preferred embodiment of the present invention. (The graph is not drawn to scale.) As described hereinabove, frequencies F1, F2, and F3 correspond respectively to pre-heating, ignition, and steady-state phases of lamp 20. Typically, after an initial start-up period of approximately 0.5 second (not shown), the pre-heating phase begins, which lasts for approximately 1.5 seconds. After completion of the pre-heating phase, the total time for transition from F1 to F3 is typically about 100 ms, although longer or shorter time periods may be appropriate for some applications. For most applications of the present invention, the graph has a generally sigmoidal shape, as in FIG. 2, characterized by smooth transitions between each of the phases.

As will be appreciated by one skilled in the art, many techniques (using analog and/or digital circuitry) can be used to generate a signal whose frequency is smoothly changed between two fixed values. For example, generator 58 may comprise a transistor controlled by a control current so as to provide a variable resistance, and thus to modulate the frequency output.

Methods and apparatus known in the prior art for controlling pre-heating and ignition of a ballast typically: (a) use one resonant circuit, and thereby cause high, damaging, wattage on the filaments during steady-state operation; or (b) use one resonant circuit and additionally use switches to reduce the wattage on the filaments during steady-state operation, (e.g., as disclosed in the above-mentioned U.S. Pat. Nos. 5,208,511 and 5,175,470). In order to reduce the consumption of electricity during steady-state operation, the present invention uses two resonating circuits in place of the switches used in the prior art. The two resonating circuits preferably comprise components such as inductors and capacitors, which are typically significantly cheaper and more reliable than switches.

Preferably, after ignition of lamps 22 and 32, energy generated by pre-heating circuit 40 that is dissipated by filaments 24, 26, 34 and 36 is substantially less than energy generated by electron-discharge circuit 52 that is dissipated in the gas between the filaments.

Figure 3D:
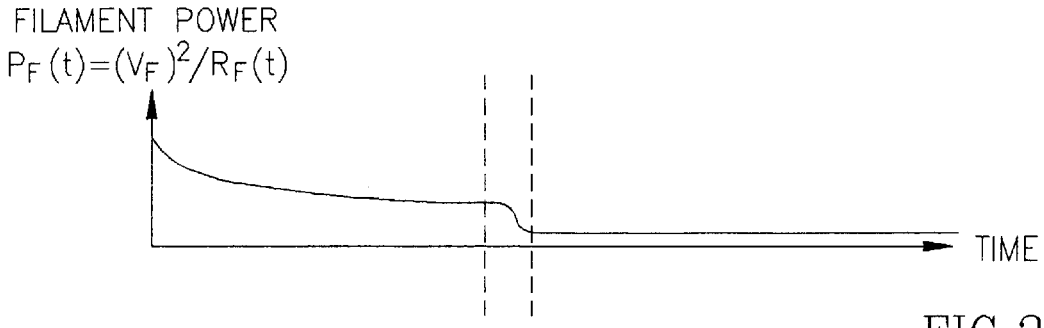

As shown by the waveform diagrams of FIGS. 3*a–d,* the operation of the electronic ballast 60 can be described in the various phases of operation beginning with pre-heating, followed by ignition and steady-state phases. The waveform diagrams illustrate the operation in terms of the signal generator 58 output frequency (FIG. 3*a*), the lamp voltage VL (FIG. 3*b*), the filament voltage VF (FIG. 3*c*) and the filament power dissipation PF (FIG. 3*d*).

Referring now to FIGS. 3*a–d,* during the pre-heating stage, the signal generator 58 output frequency (FIG. 3*a*) is F1, typically 40–60 KHz. The lamp voltage VL (FIG. 3*b*) during this stage is relatively low, thereby avoiding pre-ignition. During the pre-heating phase, the filaments are heated by a voltage-controlled technique, such that the voltage VF across the filaments (FIG. 3*c*) is controlled so as be relatively constant.

The time period within which the voltage applied to the filaments rises to its maximum value is within the standard set forth in European performance standard EN 60929. This period can vary from 20% to 40% of the pre-heating phase, due to the type of lamp and the electronic component tolerances. Once the voltage reaches its maximum, it remains relatively constant, preferably within a +/−10% range, although another suitable fluctuation range is achievable using routine skill.

Unlike with prior art designs using current control, as described in the Background, in the present invention, the power dissipation in filaments 24, 26and 34, 36 decreases as the filament resistance increases with heating (FIG. 3*d*), in accordance with the relation $P=V^2/R$, thus extending lamp life. Even where the cold filament resistance of a used lamp is higher than that associated with a new lamp, this does not become problematic with the voltage control approach, since the power dissipation decreases with heating. Reduced power dissipation causes less wear on the filaments during pre-heating, extending the life of the lamp.

As mentioned in the Summary, prior art electronic ballasts do not account for conditions obtaining in the lamp before initiating the transition from the pre-heating phase to the ignition phase, and therefore a high striking voltage is applied, causing stress on the filaments.

In contrast, the present invention provides for a smooth, continuous transition between pre-heating and ignition phases of operation. This is because as the driving frequency is adjusted downwards from the first resonant frequency over time, the point at which the lamp conditions are appropriate for achieving ignition will be automatically reached, whether or not it is the precise resonant frequency of the ignition driver circuit 52. By reduction of the driving frequency, the precise frequency at which ignition is achieved will be passed as the frequency is ultimately reduced to a third frequency for the steady-state phase of operation.

Thus, the striking voltage developed (FIG. 3*b*) across the lamps has a value just sufficient to cause ignition, without placing a stress on the filaments.

When the steady-state stage is reached, the downward shift from the frequency of pre-heating to the steady-state frequency causes the pre-heating circuit 40 to move away from its resonant frequency and transformer 50 and capacitor 48 no longer operate at the resonant frequency. Therefore, they present a high impedance, and only a small current develops in that leg of the pre-heating circuit 40, so that the voltage developed across the primary winding of transformer 50 will be a small voltage. By reflection through the secondary windings 42, 44, and 46 of transformer 50, that small voltage applies a low voltage to the filaments 24, 26, 34 and 36 (FIG. 3*c*). The low voltage applied to the filaments is applied individually, while a higher voltage is applied across the lamps in series. Thus, the filaments themselves are not being driven at any significant voltage, and therefore this protects and preserves lamp life. This is the opposite of the conditions existing in the pre-heating phase.

The low voltage applied to the filaments during the steady-state phase results in high efficiency performance.

During the ignition phase and the transition to the ignition phase, ignition will occur when ignition driver circuit 52 develops a high voltage because its resonant frequency is now being reached at the second driving frequency F2. This high voltage is applied across the lamps 22 and 32 in series, not across individual filaments. Simultaneous with the decrease in the filament voltage, the voltage across the set of lamps 22, 32 increases.

Since the signal generator 58 only generates one frequency at any given time, both conditions cannot be applied at the same time. Thus, the pre-heating and ignition phases are kept separate, and only when pre-heating phase is ended is ignition possible, so that no pre-ignition occurs.

A unique feature of the inventive design is related to the circuit configuration in which the lamp filaments are connected in parallel across the pre-heating circuit 40, and the lamps 22, 32 are connected in series across the ignition driver circuit 52. This configuration enables lamp ignition where one or even both lamp filaments are broken, in order to extend the lamp life.

In the case of a single broken filament, pre-heating is possible with the inventive configuration since the other filament, which remains intact, is connected in parallel across the pre-heating circuit 40, and can thus provide a level of pre-heating, which assists in igniting the lamp.

In the case of both broken filaments, an ignition voltage is applied nevertheless by ignition driver circuit 52 between points 47 and 51, to an in-lead 33 of each broken filament, since the lamps 22, 32 are connected in series. In many cases, this ignition voltage is sufficient to ignite the lamps, under cold start conditions, and this is known as "instant start".

The unique aspect of this capability to ignite the lamps with both broken filaments is due to two main facts: 1) the circuit configuration enables application of the ignition voltage to at least one in-lead 33 of the filament, and 2) the resistive-heating portion 35 of the filaments do not form part of the resonant circuit, so that no current path through them is required. This design is unlike prior art electronic ballast designs, using current control for pre-heating, where in many cases, a single broken filament interrupts the resonant circuit, and does not allow ignition to occur.

A comparison was conducted of the performance of the inventive electronic ballast vs. prior art electronic ballast designs, using rapid-cycle testing to determine how many on/off lamp cycles each ballast could provide before causing lamp failure. On/off testing is the standard test method for determining the rated life of fluorescent lamps as specified by the Illuminating Engineering Society of North America, in standard IES LM-40-1987. The operable assumption of these test methods is that the more times a lamp can be turned on and off, the longer is its expected life.

The parameters associated with rapid-cycle testing, which are given in the above-mentioned standard, are the ignition time cycle, which is the time between successive ignitions, and the duration of the on-time.

Referring now to Table I, there are shown the results of rigorous and repeated testing over a significant period on four electronic ballasts of different manufacturers, including the present inventive electronic ballast 60, where the tests have been run on a variety of lamps and manufacturers. The tests were run on a given batch of lamps from each manufacturer, with statistical testing methods applied to insure that each type of lamp was tested on each ballast under the same conditions.

TABLE I

| BALLAST MANUFACTURER | AVERAGE NO. OF ON-OFF CYCLES UNTIL LAMP FAILURE | NOTES |
|---|---|---|
| A | 37,440 | The failure of lamps caused the ballast to fail also |
| B | 14,220 | — |
| C | 25,920 | — |
| Present invention | 258,400 | — |

From Table I it is seen that the present inventive electronic ballast 60 allows lamps to be switched on and off almost seven times more than the types provided by manufacturer A, which represents the figure nearest to the present invention. This translates conservatively to an overall expectation of twice the lamp life of the other high frequency type ballast manufacturers.

For example, if the manufacturer of a long life lamp expects the typical performance of its lamp to have an expected life of 9500 hours, with a 90% survival rate when operated with a magnetic ballast, or 12,000 hours when operated with a standard electronic ballast, then the expected life of a lamp using the inventive electronic ballast 60 is approximately 24,000 hours, in normal use in standard applications.

Figure 4A:
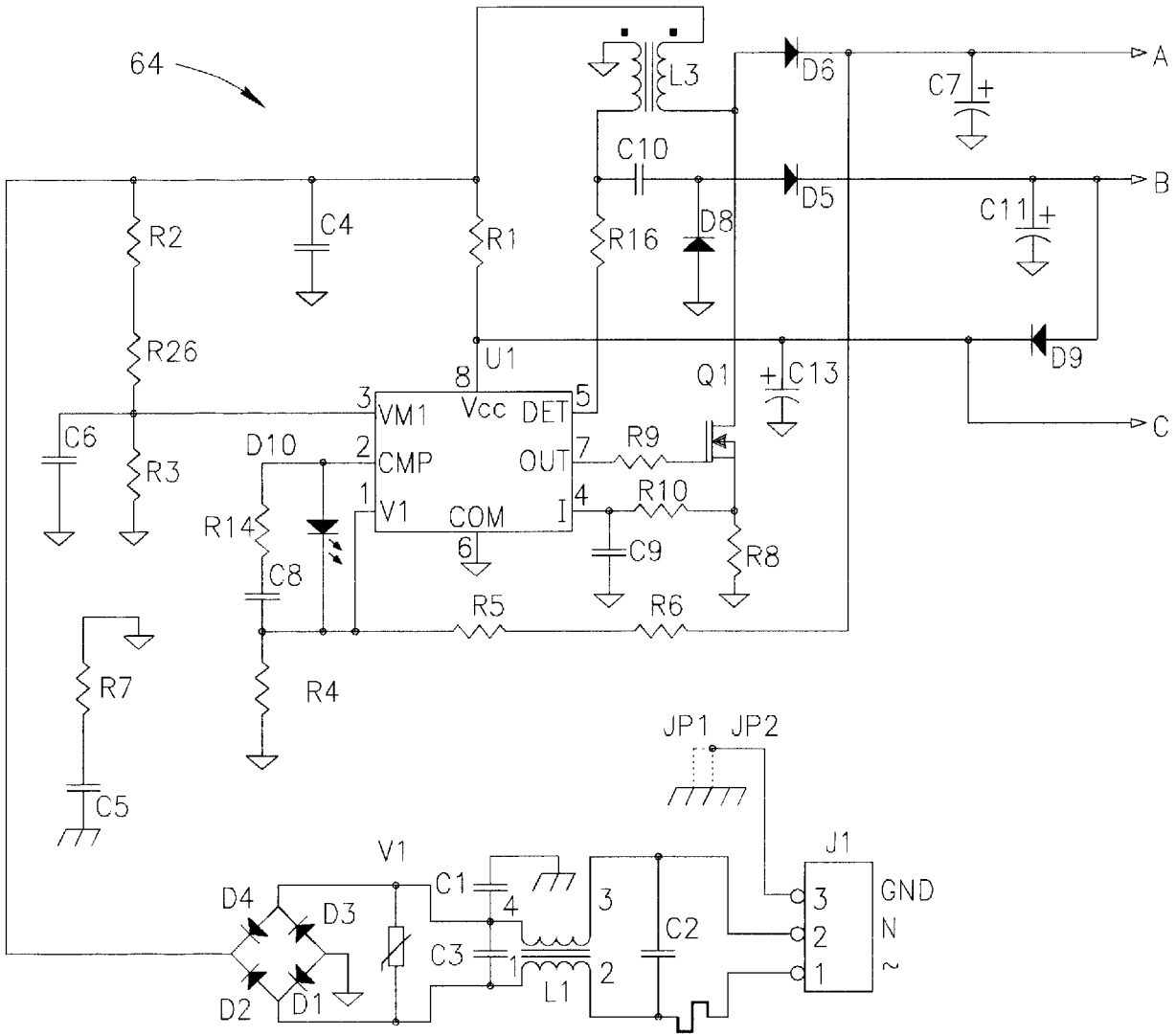
FIGS. 4*a–b* are complementary portions of a detailed electronic schematic diagram of a preferred embodiment of the electronic ballast circuit of FIG. 1.
Figure 4B:
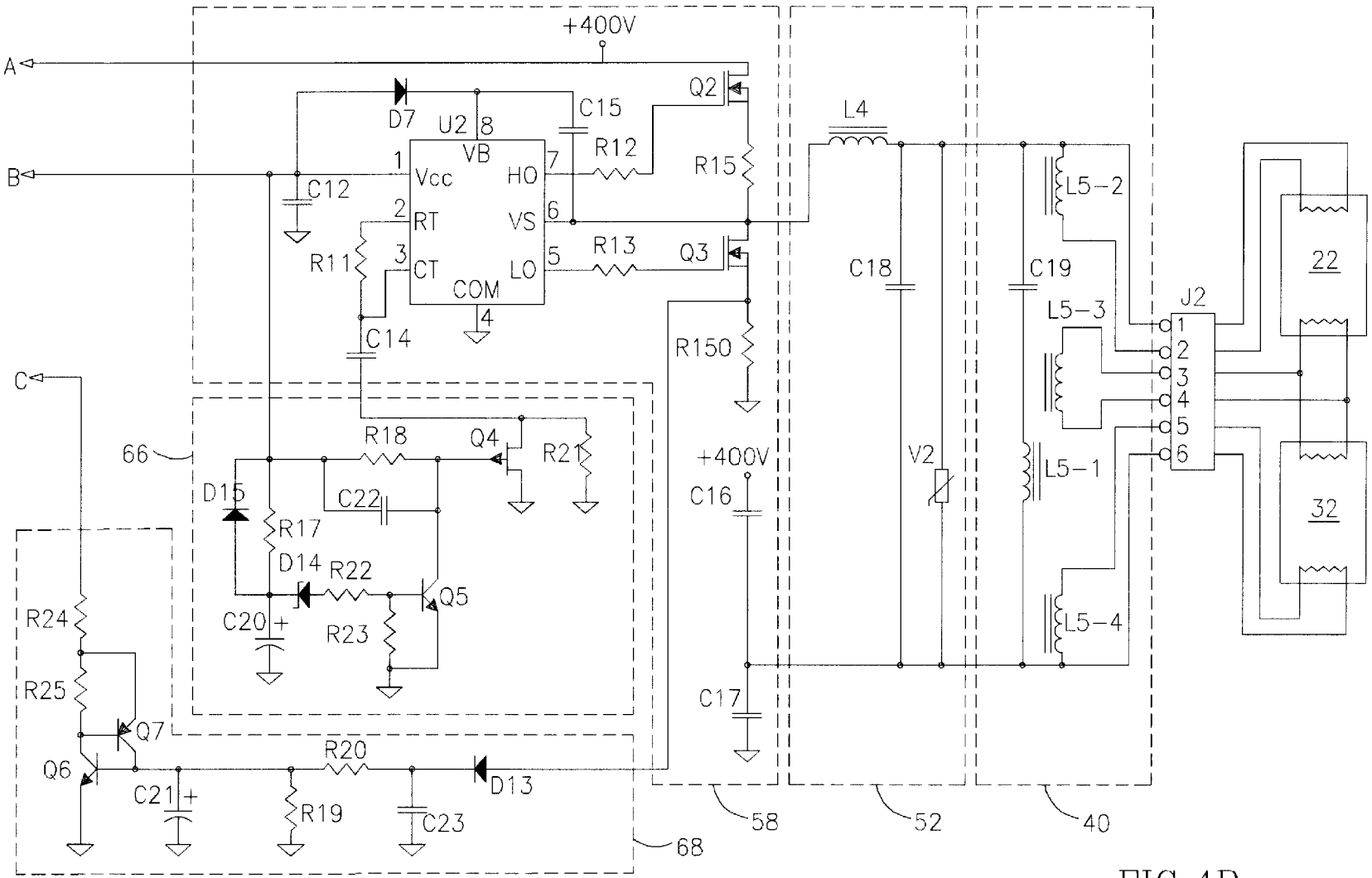

Referring now to FIGS. 4*a–b,* there are shown detailed electronic schematic diagrams of a preferred embodiment of electronic ballast circuit 60, for use with two PLL each rated at 55 watts. Ballast 60 may be implemented by application of skill of the art electronic design techniques, and arranged on a printed circuit board (not shown) for use in a ballast of a lamp including one, two, three or four fluorescent lamps, in accordance with the principles described hereinabove. The printed circuit board may be designed for use in one of the following configurations, which are known in the prior art, for the T8 range: 1×8 W, 2×18 W, 3×18 W, 4×18 W, 1×36 W, 2×36 W, 3×36 W, 1×58 W, 2×58 W, 1×70 W, or 2×70 W. The first of these numbers refers to the number of lamps, and the second number refers to the wattage of the lamp(s). The printed circuit board may also be arranged to operate with the compact PLL lamps, such as the 1×55 W, 2×55 W Compact configurations, 1×36 W, 2×36 W Compact configurations, and the 1×40, 2×40 W Compact configurations, as are known in the prior art. The printed circuit board preferably is supplied with an input voltage of 230 VAC at 50 Hz, and can operate when the input voltage is between 198 VAC and 264 VAC. With appropriate changes, the printed circuit board can be modified to accept 110 VAC at 60 Hz.

Terminal block J2 in FIG. 4*b* comprises coupling points for the one or more lamps used with the printed circuit board. Some of the components on the printed circuit board correspond to components in ballast 60, shown in FIG. 1. For example, L4, L5, and C18 correspond respectively to inductor 56, transformer primary 50, and capacitor 54. Additionally, capacitor C19 performs the function of capacitor 48 (FIG. 1).

The AC-DC converter 64 including power factor correction can be implemented using a KA7524 Samsung type integrated circuit U1, providing a 12 volt DC output. The input to ballast 60 is connected to phase, neutral and ground at terminal block J1, and an RFI input filter is provided by inductor L1 and capacitors C1, C2 and C3. A full wave rectifier is provided by diodes D1–D4.

Signal frequency generator 58 forming a portion of the frequency control circuitry 66 may be implemented by use of a IR2155 type chip U2 arranged as a multivibrator and driver.

The frequency control circuit 66 operates to control the frequency of generator 58 by changing the resistance of FET Q4 which is in connected in parallel to resistor R21. This equivalent resistance together with capacitor C14 determines the frequency of generator 58. Initially, the FET Q4 is cut-off, so that the frequency of generator 58 is determined by resistor R21 and capacitor C14, providing a high frequency used in the pre-heating phase. Capacitor C20 is charged through resistor R17 so that it builds up voltage toward 12 v.

When the voltage on capacitor C20 reaches approximately 8 volts, transistor Q5 is driven toward saturation, and the equivalent resistance of FET Q4 and resistor R21 is reduced, and the frequency or generator 58 is also reduced. As this occurs, the ignition phase is entered, as shown in FIG. 3*a*. The reduction in generator 58 frequency causes the ignition driver circuit 52 to resonate, increasing the voltage across the lamps, so as to ignite them.

When transistor Q5 is saturated, then resistor R21 is shorted out, and the steady-state phase is reached (FIG. 3*a*).

The protection circuit 68 operates when the frequency generator 58 output on FETs Q2 and Q3 is overloaded, in order to prevent damage to itself. Resistor R150 is connected to sense the output load as a voltage, which charges capacitors C23 and C21, and if this voltage continues to build, Darlington transistor arrangement Q6–Q7 will act as a clamp on the signal frequency generator 58, causing it to enter a protection mode, in which it is cutoff.

Table II below shows a list of appropriate components and values corresponding thereto which are typically used in assembling the board, although it will be understood by one skilled in the art that the principles of the present invention can be realized with different components or with a different layout of the printed circuit board.

Having described the invention with regard to certain specific embodiments thereof, it is to be understood that the description is not meant as a limitation, since further modifications may now suggest themselves to those skilled in the art, and it is intended to cover such modifications as fall within the scope of the appended claims.

TABLE II

| No. | Type | Description | Designation |
|---|---|---|---|
| | | SEMI CONDUCTOR COMPONENTS | |
| 1 | DIS | RECTIFIER DIODE 1N4007 | D1,D2,D3,D4 |
| 2 | DIS | SMALL SIGNAL DIODE 1N4148 | D5,D8,D9,D13,D15 |
| 3 | DIS | ULTRAFAST DIODE UF 1005 | D6,D7 |
| 4 | DIS | 5 mm RED LED CUR53D | D10 |
| 5 | DIS | ZENER DIODE 1N755A | D14 |
| 6 | DIS | TRANSISTOR IRF840 | Q1,Q2,Q3 |
| 7 | DIS | TRANSISTOR 2N5461 | Q4 |
| 8 | DIS | TRANSISTOR 2N3904 | Q5,Q6 |
| 9 | DIS | TRANSISTOR 2N3906 | Q7 |
| 10 | IC | MC KA7524B | U1 |
| 11 | IC | MC IR2155 | U2 |
| 12 | DIS | VARISTOR 10D431K | V1 |
| 13 | DIS | VARISTOR 7D821K | V2 |
| | | INDUCTORS | |
| 14 | IND | EE-25 COM. MODE IND 5012: 36 mH | L1 |
| 15 | IND | EE-28 BUSTER IND 5039: 1 mH, 3Ts | L3 |
| 16 | IND | EE-28 OUT.IND 7064: 1.95 mH | L4 |
| 17 | IND | EE-19 PREHEAT. IND. 7065: 2.616 mH 6Ts, 6Ts, 6Ts | L5 |
| | | CAPACITORS | |
| 18 | CAP | 1nF, 250VAC, 10% Y5P, DISC CER CAP | C1 |
| 19 | CAP | 330nF, 630V, 20% METAL PYEST CAP | C2 |
| 20 | CAP | 220nF, 630V, 20% METAL PYEST CAP | C3,C16,C17 |
| 21 | CAP | 220NF, 400V, 20% METAL PYEST CAP | C4 |
| 22 | CAP | 2.2nF, 250VAC, 10%, Y5P, DISC CER CAP | C5 |
| 23 | CAP | 10nF, 50V, 20% CER CAP (Y5P) | C6,C23 |
| 24 | CAP | 22 μF, 450V, 20% EL CAP 5kH El Cap | C7 |
| 25 | CAP | 330nF, 50V, 20% METAL PYEST CAP | C8,C12 |
| 26 | CAP | 1nF, 50V, 20% CER CAP (Y5P) | |
| 27 | CAP | 22nF, 100VDC/63VAC, 10% METAL PYEST CAP | C10 |
| 28 | CAP | 47 μF, 35V (25V), 10% EL CAP (5x11) | C11 |
| 29 | CAP | 68 μF, 25V, 20% EL CAP (6.3X11) | C13 |
| 30 | CAP | 1nF, 50VDC, 2.5% MET.POLYPHEN.SULF.CAP | C14 |
| 31 | CAP | 100nF, 50V, 20% METAL PYEST CAP | C15,C22 |
| 32 | CAP | 6.8nF, 1kV, 5% METAL PYPROP CAP | C18 |
| 33 | CAP | 5nF, 1kV, 5% METAL PYPROP CAP | C19 |
| 34 | CAP | 10 μF, 50V(16V), 10% EL CAP (5X11) | C20,C21 |
| | | RESISTORS | |
| 35 | RES | 200kOhm, 1W, 5% CARBON RES | R1 |
| 36 | RES | 2.2MOhm, 0.5W, 5% CARBON RES | R2 |
| 37 | RES | 14kOhm, 0.25W, 1% METAL FILM RES | R3 |
| 38 | RES | 10kOhm, 0.25W, 1% METAL FILM RES | R4 |
| 39 | RES | 787kOhm, 0.6W, 1% METAL FILM RES | R5,R6 |
| 40 | RES | 100 Ohm, 0.25W, 5% CARBON RES | R7 |
| 41 | RES | 0.33 Ohm, 0.5W, 5% CARBON RES | R8 |
| 42 | RES | 10 Ohm, 0.25W, 5% CARBON RES | R9 |

TABLE II-continued

| No. | Type | Description | Designation |
|---|---|---|---|
| 43 | RES | 330 Ohm, 0.25W, 5% CARBON RES | R10 |
| 44 | RES | 30.1k 0.25W, 1% METAL FILM RES | R11 |
| 45 | RES | 27 Ohm, 0.25W, 5% CARBON RES | R12,R13 |
| 46 | RES | 9.1kOhm, 0.25W, 5% CARBON RES | R14 |
| 47 | RES | 1.0 Ohm, 0.5W, 1% or 5% METAL FILM RES | R15,R150 |
| 48 | RES | 22kOhm, 0.25W, 5% CARBON RES | R16 |
| 49 | RES | 182kOHM, 0.25W, 1% METAL FILM RES | R17 |
| 50 | RES | 100kOhm, 0.25W, 5% CARBON RES | R18,R22,R23 |
| 51 | RES | 10kOhm, 0.25W, 5% CARBON RES | R19 |
| 52 | RES | 22kOhM, 0.25W, 5% CARBON RES | R20 |
| 53 | RES | 10.2k, 0.25W, 1% METAL FILM RES | R21 |
| 54 | RES | 51 Ohm, 0.25W, 5% CARBON RES | R24 |
| 55 | RES | 3kOhm, 0.25W, 5% CARBON RESISTOR | R25 |
| 56 | RES | 2.4MOhm, 0.5W, 5% CARBON RES | R26 |

What is claimed is:

1. An electronic ballast for providing electrical energy to at least one fluorescent lamp having first and second electrical discharge filaments, each with a resistive-heating portion and a pair of electrical in leads, said ballast comprising:

a pre-heating circuit having a first resonant frequency, coupled to pre-heat the filaments;

an ignition driver circuit having a second resonant frequency, coupled to ignite an electrical discharge through a gas between the filaments; and power controller circuitry, which provides power to the pre-heating and ignition driver circuits in succession so as to ignite the at least one lamp by first providing power to the pre-heating circuit substantially at the first resonant frequency in a pre-heating phase and subsequently providing power to the ignition driver circuit substantially at the second resonant frequency in an ignition phase, such that the frequency at which power is provided from said first resonant frequency to said second resonant frequency is smoothly varied so as to avoid resonance of said pre-heating and ignition driver circuits simultaneously, thereby avoiding pre-ignition of the at least one lamp, wherein said pre-heating circuit is operated in a predetermined interval for heating the filaments.

2. The ballast of claim 1 wherein said smooth variation in frequency between said first and second resonant frequencies occurs in a gradient of approximately 30 KHz/5 msec.

3. The ballast of claim 1 wherein said pre-heating circuit is operated for a predetermined interval for heating the filaments.

4. The ballast of claim 3 wherein said predetermined interval is in the range of 0.5–1.5 seconds.

5. The ballast of claim 1 wherein said pre-heating circuit applies a respective substantially constant voltage across each of the filaments during said pre-heating phase, such that power dissipation of the filaments decreases as their resistance increases, to extend lamp life.

6. The ballast of claim 5 wherein said filament resistance increases due to pre-heating.

7. The ballast of claim 5 wherein said filament resistance increases due to ageing.

8. The ballast of claim 1 wherein each of said pre-heating circuit and said ignition driver circuit are resonant circuits, said lamp being connected such that the filament does not provide a current path in either of said resonant circuits.

9. The ballast of claim 1 wherein said ignition driver circuit develops a striking voltage for igniting the lamp in said ignition phase, said striking voltage being applied across a lamp filament pair to successfully start the lamp regardless of whether a filament is broken.

10. The ballast of claim 1 wherein said ignition driver circuit develops a striking voltage for igniting the lamp in said ignition phase, said striking voltage being applied across a lamp filament pair to successfully start the lamp regardless of whether both of the filaments are broken.

11. The ballast of claim 1, wherein said power controller circuitry, in a steady-state phase subsequent to ignition, varies its output frequency to a third frequency, in order to drive current through the gas and cause the at least one lamp to emit light, the magnitude of said power provided at the third frequency being lower than the magnitude of said power provided at the second frequency, and wherein said steady-state phase of operation is characterized by application of a relatively low voltage across individual filaments.

12. The ballast of claim 11 wherein said third frequency is in the range of approximately 22–32 KHz.

13. The ballast of claim 1 wherein said first resonant frequency is in the range of approximately 40 Khz to 60 KHz.

14. The ballast of claim 1 wherein said second resonant frequency is in the range of approximately 25–35 KHz.

15. The ballast of claim 1 wherein said pre-heating circuit is respectively coupled to each of the filaments in a parallel connection.

16. The ballast of claim 1 wherein said ignition driver circuit is coupled to the filaments of said lamps in a series connection.

17. An electronic ballast for providing electrical energy to at least one fluorescent lamp having first and second electrical discharge filaments, each with a resistive-heating portion and a pair of electrical in-leads, said ballast comprising:

a pre-heating circuit having a first resonant frequency, coupled to pre-heat the filaments;

an ignition driver circuit having a second resonant frequency, coupled to ignite an electrical discharge through a gas between the filaments; and power controller circuitry, which provides power to the pre-heating and ignition driver circuits in succession so as to ignite the at least one lamp by first providing power to the pre-heating circuit substantially at the first resonant frequency in a pre-heating phase and subsequently providing power to the ignition driver circuit substantially at the second resonant frequency in an ignition phase, wherein said pre-heating circuit applies substantially constant voltage across each of the filaments during said pre-heating phase, such that power dissipation of the filaments decreases as their resistance increases, to extend lamp life.

18. The ballast of claim 17 wherein said power controller circuitry smoothly varies the frequency at which it provides power from said first resonant frequency to said second resonant frequency upon termination of said pre-heating phase and initiation of said ignition phase.

19. The ballast of claim 18 wherein said pre-heating circuit is respectively coupled to each of the filaments in parallel.

20. The ballast of claim 19, wherein the ballast provides energy to a plurality of fluorescent lamps, such that said ignition driver circuit is coupled across said plurality of lamps which are connected in series between filaments on opposite sides of each of said plurality of lamps.

21. An electronic ballast for providing electrical energy to a plurality of fluorescent lamps each having first and second electrical discharge filaments, each with a resistive-heating portion and a pair of electrical in-leads, said ballast comprising:

a pre-heating circuit having a first resonant frequency, coupled to pre-heat the filaments;

an ignition driver circuit having a second resonant frequency, coupled to ignite an electrical discharge through a gas between the filaments; and power controller circuitry, which provides power to the pre-heating and ignition driver circuits in succession so as to ignite the plurality of lamps by first providing power to the pre-heating circuit substantially at the first resonant frequency in a pre-heating phase and subsequently providing power to the ignition driver circuit substantially at the second resonant frequency in an ignition phase, wherein said pre-heating circuit applies substantially constant voltage across each of the filaments during said pre-heating phase, such that power dissipation of the filaments decreases as their resistance increases, said power controller circuitry smoothly varies the frequency at which it provides power from said first resonant frequency to said second resonant frequency upon termination of said pre-heating phase and initiation of said ignition phase, said pre-heating circuit is respectively coupled to each of the filaments in parallel, and said ignition driver circuit is coupled across the plurality of lamps which are connected in series between filaments on opposite sides of each of said plurality of lamps, whereby said electronic ballast is operable in on-off switching cycles each comprising said pre-heating phase, and said ignition phase, said on-off switching cycles being repeatable in excess of between about seven and ten times more than with other generally available ballasts using current-controlled pre-heating, said electronic ballast providing an electrical discharge to ignite said plurality of fluorescent lamps for a lifetime approximately double that of existing lamps.

22. The ballast of claim 21 wherein said plurality of lamps comprises a pair of series-connected lamps, and wherein said ignition driver circuit develops a striking voltage for igniting said pair of lamps in said ignition phase, said striking voltage being applied across a lamp filament pair of said series-connected pair of lamps to successfully start said lamps regardless of whether between three and four filaments are broken.

23. The ballast of claim 21 wherein said plurality of lamps comprises four series-connected lamps, and wherein said ignition driver circuit develops a striking voltage for igniting said lamps in said ignition phase, said striking voltage being applied across a lamp filament pair of said series-connected lamps to successfully start said lamps regardless of whether between three and five filaments are broken.

24. A method for providing electrical energy to at least one fluorescent lamp having filaments, said method comprising the steps of:

generating a driving current at a first resonant frequency to pre-heat the filaments of the at least one lamp, wherein the driving current is generated as a resonant current flow in pre-heating circuitry coupled to the filaments of the one or more fluorescent lamps in order to drive current through the filaments, and changing the driving current to a second resonant frequency in order to ignite an electrical discharge between the filaments with the at least one lamp, wherein the driving current at the second resonant frequency is generated as a resonant current flow in ignition driver circuitry coupled to the at least fluorescent lamp in order to drive current through gas between the filaments in the at least one lamp, said changing step comprising smoothly modulating the frequency of the driving current from the first resonant frequency to the second resonant frequency, said smoothly modulated change in frequency between said first and second resonant frequencies avoiding pre-ignition of the at least one lamp.

25. The method of claim 24 wherein said generating step includes applying a respective, substantially constant voltage across each of the filaments, such that power dissipation of said filaments decreases as their resistance increases.

26. The method of claim 24 wherein said changing step develops a striking voltage for igniting the lamp, said striking voltage being applied across a lamp filament pair to successfully start the lamp regardless of whether one filament is broken.

27. The method of claim 24 wherein said changing step develops a striking voltage for igniting the lamp, said striking voltage being applied across a lamp filament pair to successfully start the lamp regardless of whether both of said filaments are broken.

28. The method of claim 24 wherein after lamp ignition a relatively low voltage is applied across individual filaments.

29. The method of claim 24 wherein said first resonant frequency is in the range of approximately 40 Khz to 60 KHz.

30. The method of claim 24 wherein said second resonant frequency is in the range of approximately 25–35 KHz.

31. The method of claim 24, further comprising the step of changing the driving current from the second frequency to a third frequency in the range of approximately 22–32 KHz in order to drive current through the gas and cause the at least one lamp to emit light, the magnitude of the current driven at the third frequency being lower than the magnitude of the current driven at the second frequency.

32. The method of claim 24 wherein said driving current at said first frequency is coupled to the filaments of said at least one lamp in a parallel connection.

33. The method of claim 24 wherein said driving current at said second frequency is applied to the filaments of said at least one lamp in a series connection.

34. The method of claim 24 wherein said generating step is performed for a predetermined interval to heat the filaments.

35. The method of claim 34 wherein said predetermined interval is in the range of 0.5–1.5 seconds.

36. The method of claim 24 wherein said generating step includes applying a respective, substantially constant voltage across each of the filaments, such that power dissipation of the filaments decreases as their resistance increases, said step of changing the driving current comprises smoothly modulating the frequency of the driving current from the first frequency to the second frequency, and said generating and changing steps are repeatedly performed in on-off switching cycles, whereby said switching cycles are repeatable in excess of between about seven and ten times more than other generally available methods using current-controlled pre-heating, providing an electrical discharge to ignite said fluorescent lamp for a lifetime approximately double that of existing lamps.

* * * * *